US006959568B2

(12) United States Patent
Abeler

(10) Patent No.: US 6,959,568 B2
(45) Date of Patent: Nov. 1, 2005

(54) APPARATUS FOR INDICATING A CLOSURE STATE OF A LOCK

(76) Inventor: Ulrich Abeler, Lindemannskamp 2A, D-49070 Osnabrock (DE)

( * ) Notice: Subject to any disclaimer, the term of this patent is extended or adjusted under 35 U.S.C. 154(b) by 0 days.

(21) Appl. No.: 10/718,778

(22) Filed: Nov. 21, 2003

(65) Prior Publication Data

US 2004/0103702 A1 Jun. 3, 2004

Related U.S. Application Data

(63) Continuation of application No. PCT/EP02/05911, filed on May 29, 2002.

(30) Foreign Application Priority Data

May 30, 2001 (DE) ..... 101 26 526

(51) Int. Cl.[7] ..... E05B 41/00; E05B 19/04

(52) U.S. Cl. ..... 70/432; 70/408; 70/DIG. 59; 200/224

(58) Field of Search ..... 70/432–437, 408, 70/460, 441, DIG. 59; 116/80, DIG. 7; 340/542; 200/224, 183, 189

(56) References Cited

U.S. PATENT DOCUMENTS

| | | | | |
|---|---|---|---|---|
| 4,631,943 A | | 12/1986 | Hoener | 70/395 |
| 4,908,605 A | * | 3/1990 | Takatsuka | 340/542 |
| 5,025,426 A | * | 6/1991 | Blumberg et al. | 368/10 |
| 6,255,957 B1 | * | 7/2001 | Sonderegger et al. | 340/686.1 |

FOREIGN PATENT DOCUMENTS

| | | |
|---|---|---|
| DE | 32 07 998 A1 | 9/1983 |
| DE | 34 07 033 A1 | 11/1984 |
| DE | 43 27 294 A1 | 7/1994 |

* cited by examiner

*Primary Examiner*—Lloyd A. Gall
(74) *Attorney, Agent, or Firm*—Laurence A. Greenberg; Werner H. Stemer; Ralph E. Locher

(57) ABSTRACT

An apparatus indicates the closure state of a key-operated lock, having a housing that is fitted to the key and has a rotation detection sensor which is held therein and comprises a hollow body that is filled with a first electrically conductive liquid and has electrically conductive contacts for production of electrical contact sequences which are dependent on the closing direction, and having an electronic evaluation unit which uses the contact sequences to determine the closure state of the lock. The hollow body is substantially completely filled with the first electrically conductive liquid and with a second electrically non-conductive fluid that repels the first liquid.

18 Claims, 5 Drawing Sheets

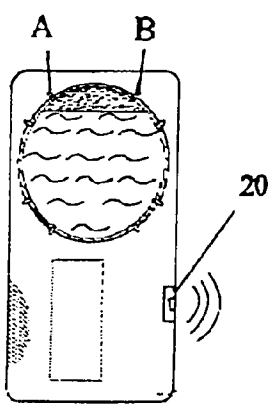
FIG. 3A
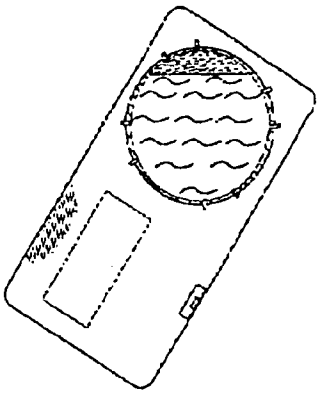
FIG. 3B
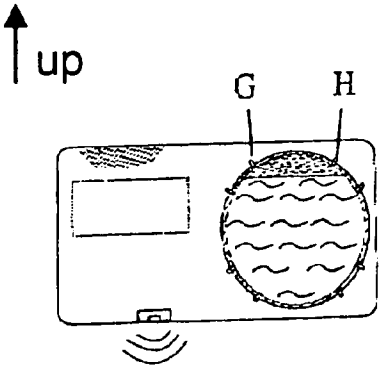
FIG. 3C
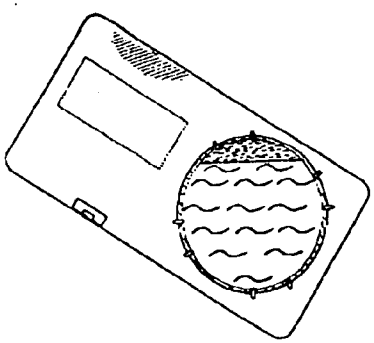
FIG. 3D
FIG. 3E
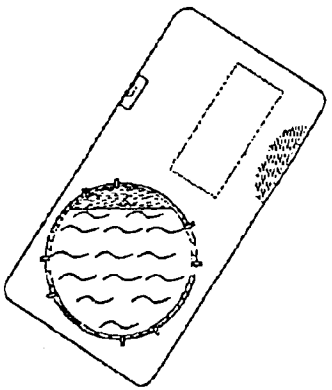
FIG. 3 F
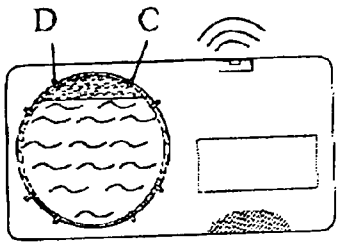
FIG. 3G
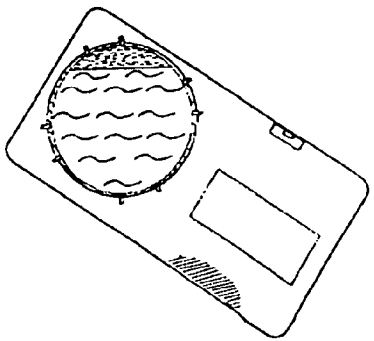
FIG. 3H

APPARATUS FOR INDICATING A CLOSURE STATE OF A LOCK

CROSS-REFERENCE TO RELATED APPLICATION

This application is a continuation of copending International Application No. PCT/EP02/05911, filed May 29, 2002, which designated the United States and which was not published in English.

BACKGROUND OF THE INVENTION

Field of the Invention

The invention relates to an apparatus for indicating the closure state of a lock, that is of a key-operated lock. The apparatus has a housing which is fitted to the key and has a rotation direction sensor disposed therein. The rotation direction sensor comprises a hollow body that is filled with a first electrically conductive liquid and has electrical contacts for producing electrical contact sequences that are dependent on the closing direction. An electronic evaluation unit uses the electrical contact sequences to determine the closure state of the lock.

In daily life, it is generally necessary to lock the door of a building, of an office, of a dwelling, of a motor vehicle etc. for protection against access by unauthorized persons, when there is no longer anyone who is authorized therein. The person who is the last to leave the building, for example, has to take care to ensure that the appropriate door is actually locked and is not just closed, since a door which is only "pulled to" can be opened by an unauthorized person using simple means and in a very short time, and thus offers only little protection.

In practice, it has often been found in this context that corresponding doors are merely pulled to and are not locked, and that the relevant person in general does not wonder until some time later whether he or she has actually locked the door, or only pulled it to. As is shown from experience, the question can frequently be clarified only by the person returning to the relevant door in order to check it. Since, however, the person has often traveled some distance away from the corresponding door during this time, return is always associated with a greater or lesser amount of personal effort and loss of time. In particular, this results in major annoyance when the door was actually locked, as opposed to just "pulled to," and a relatively long distance has had to be traveled in order to find this out.

German patent DE 43 27 294 C2 describes an apparatus for indicating the closure state of a key-operated lock. The apparatus is attached to the key body of a key. The indication apparatus is activated by insertion of the key into the lock, and indicates the closure state of the lock after the closing process and the withdrawal of the key. The closure state is thereby determined by way of an electronic evaluation unit which is connected to one or more rotation direction sensors. The rotation direction sensors surround a bolt channel with electrical contacts which are arranged in it and are closed and opened by means of a ball (which is likewise arranged in the bolt channel) or an electrically conductive liquid depending on the orientation of the key head in the earth's field of gravity, that is its geodetic orientation. The evaluation unit uses the signals which are associated with the opening and closing of the electrical contacts to determine a value for the closure state of the lock, and this is then supplied to a visual or acoustic indication unit. The described apparatus has the problem that the contacts are frequently not reliably closed by the liquid or the balls, and/or that the same contact may be closed more than once by splashing of the liquid or bouncing of the balls, and this can lead to indication errors.

Furthermore, the apparatus requires an activation apparatus which generally has to be operated mechanically when the key is inserted into the lock, in order to reset the evaluation unit. In addition to the risk of the activation apparatus becoming dirty and being randomly initiated inadvertently in pants pockets, this results in the risk of the apparatus generally having to be specifically matched to the respective design of a lock.

German published patent application DE 32 07 998 A1 discloses a key with a memory display for indication of the closure state of a door. That apparatus has a rotation direction sensor which comprises two small cylindrical tubes that are oriented perpendicular to one another, are partially filled with an electrically conductive liquid and, at each of their ends, have two electrical contacts which are alternately conductively bridged by the liquid during rotation of the key in the lock. The switching states of the contacts are supplied to an evaluation unit, which uses them to determine the closure state of the lock. The small tubes are arranged on the key in such a way that they include an angle of 45° with the horizontal after the insertion of the key into the lock, so that those contacts which are located below the horizontal are conductively bridged by the liquid in order to produce a well-defined switching state. The apparatus has the disadvantage that the 45° arrangement of the small tubes means that a closing process is indicated only when the key has been turned through more than 45° in the lock. Furthermore, there is a risk if the closing process is carried out quickly of splashing of the liquid in the small tubes being able to lead to inadvertent closing of a contact, and thus to malfunctions.

Furthermore, similar to the apparatus disclosed in the above-noted German patent DE 43 27 294 C2, the apparatus requires a mechanical activation apparatus which must be operated during the insertion of the key into the lock, in order to reset or to activate the evaluation unit.

German published patent application DE 34 07 033 A1 discloses a key with a memory display that is controlled by way of the opposing forces caused in the lock during the closing process. The key has a shank part which is connected to the grip part of the key via a peg such that it can rotate. The grip part can be locked axially and, depending on the rotation direction, radially, on the peg by means of pin arrangements. In contrast to the subject matter of the invention, the operation of the indication apparatus is dependent on the one hand on the minimum opposing force produced by the lock during the closing process while, on the other hand, the arrangement is dependent from the start on a specially designed key, so that the indication apparatus can be retrofitted only in a very complex manner, if at all.

SUMMARY OF THE INVENTION

It is accordingly an object of the invention to provide an apparatus for indicating the closure state of a key-operated lock which overcomes the above-mentioned disadvantages of the heretofore-known devices and methods of this general type and which enables the closure state of the key-operated lock to be determined reliably and in a simple manner at any desired location and at any time.

With the foregoing and other objects in view there is provided, in accordance with the invention, an apparatus for indicating a closure state of a key-operated lock. The apparatus comprises:

a housing mounted to a key that is associated with the key-operated lock;

a rotation direction sensor disposed in the housing and having:

a hollow body substantially completely filled with a first electrically conductive fluid and with a second electrically non-conductive fluid repelling the first fluid; and electrically conductive contacts for production of electrical contact sequences in dependence on a position of the first fluid and the second fluid in the hollow body representing a closing direction;

an electronic evaluation unit connected to receive the electrical contact sequences to determine the closure state of the lock.

In other words, the apparatus for indication of the closure state of a lock has a housing which is fitted to the key, is preferably connected even during manufacture of the key to the base body of the key and, in particular, can be provided with labels for advertising purposes.

A rotation direction sensor is disposed within the housing and has a completely closed hollow body that is filled with a first electrically conductive liquid and is provided on its inner face with two or more contacts that are arranged at a distance from one another and are connected to an electronic evaluation unit via electrical connecting lines. In addition to the first electrically conductive liquid, the hollow body is filled with a second liquid, which is electrically non conductive or is at least not such a good conductor, and which cannot be mixed with the first liquid, or repels it. The liquids may, for example, be oil and water, (distilled) water and mercury, or any other known liquids with different specific conductivities, with the first conductive liquid preferably having a lower density than the second less highly conductive or non-conductive liquid. This allows the logic of the electronic evaluation unit to be kept particularly simple, with the evaluation unit determining the closure state of the lock as a function of the rotation direction of the key in the lock and of the characteristic sequence, which is associated with this, of opened contacts and contacts which are bridged by the conductive liquid—also referred to in the following text as the contact sequence.

The contacts which are bridged by the conductive liquid are referred to in the following text for the sake of simplicity as being closed, and the contacts which are bridged by the second, non-conductive or poorly conductive liquid are referred to as being opened, even though, to be precise, these are just changes in the electrical resistance between two contacts. Where the following text refers to contacts this means, to be precise, pairs of contacts which are in each case arranged separated by, for example, 2 to 5 mm within the circumferential surface of the hollow body, depending on the size of the rotation direction sensor. However, in the same way, it is likewise possible for the contact pairs which are bridged by the conductive liquid to be formed by means of a contact in the area of the side wall of the hollow body and a further contact in the area of the inner circumferential surface of the hollow body.

The apparatus according to the invention has the advantage that, when the hollow body is aligned appropriately in the housing and with respect to the rotation axis of the key in the lock, this allows a reliable indication of the closure state without any absolute need for an activation device which activates or resets the evaluation unit on insertion of the key into the lock.

This is due to the fact that the two liquids completely fill the cavity and—owing, for example, to the known spirit level effect—only an absolutely horizontal position of the key rotation axis as well as an absolutely vertical position of the key plane lead to closure of the corresponding contacts located at the top by means of the lighter, electrically conductive, first liquid. As soon as the corresponding contacts are closed for a specific minimum period of, for example, 1 to 2 seconds and, following this, a sequence (which is characteristic of an unlocking process or of a locking process) of closure states of the other contacts is preferably likewise recorded by the evaluation unit within a predetermined time period of, for example, 1 to 2 seconds, the closing process is assessed as such, and the associated closure state is presented, for example, acoustically and/or in the form of a visual indication on a display, or by means of light-emitting diodes which can be activated.

This makes it possible to ensure that the evaluation unit can distinguish with a very high degree of confidence between closing processes and random movements and rotations of the key, such as those which occur in pants pockets. There is generally no longer any need for an activation unit, whose mechanism is complex and susceptible to defects and which, for example, makes mechanical contact with the outside of the lock, or such an activation unit is required only for very specific locks wherein the closing process requires the key to be rotated only through a few degrees, for example through less than 20°.

The shape of the hollow body is matched to the respective type of lock, for example depending on whether the lock closes by turning it clockwise or counterclockwise, and/or whether the lock requires one complete revolution or only a revolution of the key through a few degrees, for example 10°, in order to be opened or locked.

According to one preferred embodiment of the invention, the hollow body is in the form of a prism with two base surfaces which run essentially parallel to one another, with the base surfaces preferably being arranged essentially at right angles to the rotation axis of the key in the lock. This results in the advantage that the liquids in the hollow body can circulate without any significant friction losses or flow swirling during a closing process, thus also reducing the risk of a suspension of the two liquids being formed.

A further improvement to the precision and insensitivity to faults of the apparatus is obtained in particular in conjunction with the prismatic configuration of the hollow body, and a corresponding arrangement of the contacts within the hollow body, when the amount of light, electrically conductive, first liquid is chosen to be less than the amount of the heavier, electrically non-conductive second liquid.

Thus, by way of example, the hollow body may have an essentially cylindrical cross-sectional shape, with the cylinder longitudinal axis pointing in the direction of the rotation axis, or essentially parallel to the rotation axis, of the key in the lock.

In the same way, it is likewise feasible for the hollow body to have the cross-sectional shape of a rosette, or of an annular structure which is composed of a large number of circular arc sections, for example four or more circular arcs, with the contacts preferably being arranged at a distance from the intersections of the circular arcs. This rosette-like cross-sectional shape allows the reliability with which the indication apparatus is activated exclusively when the key is inserted into a lock and during a subsequent closing process to be improved in comparison to a purely circular cross-sectional shape, particularly when the contacts which are located at the top during insertion of the key are arranged in such a way that they are closed at the same time only when the key position is absolutely vertical, with this being identified by the evaluation unit as the start of a closing process. As soon as the key is rotated about the rotation axis through only a small number of degrees from the vertical, and/or the rotation axis of the key is arranged inclined with respect to the horizontal, as is normally the case with a key which has not been inserted into the lock, the two contacts are in this embodiment of the invention not bridged by the first liquid, so that this is assessed by the evaluation device as not being a closing process that is being carried out.

It may also be advantageous for the circumferential inner wall of the hollow body to have a cross-sectional shape which is curved radially outwards or runs to a point in a V shape, in whose periphery the contacts are arranged in such a manner that the lighter, electrically conductive, first liquid bridges the contacts only when the key is horizontal. This allows the reliability with which a closing process can be distinguished from random bridging of the contacts to be improved further, since the key is always horizontal during one complete revolution in the lock—in contrast to the situation in pants pockets.

According to a further embodiment of the invention, the hollow body has a kidney-shaped or cardioid cross section, thus likewise ensuring reliable indication of the closure state, particularly in the case of locks, such as motor vehicle locks, wherein the closing or opening process is carried out by rotating the key through a few degrees, for example 45°.

However, in the same way, it is likewise possible for the hollow body to be spherical, or to have some other shape that is matched to the particular lock.

In the preferred embodiment of the invention, an activation switch is preferably arranged on the housing of the indication apparatus, and this activation switch can be operated from the outside before the closing process, for example with the thumb or with the thumb and index finger, in order to activate the evaluation unit if required before a closing process that is intended to be carried out.

In this case, it may be particularly advantageous for the evaluation unit to be switched in such a way, that after operation of the activation switch for a preferably short time period, a change in the closure state of the lock is considered by the evaluation unit to be probable only when a contact sequence which is characteristic of a locking process or opening process is detected subsequently within a predetermined time period of, for example, 1 to 5 seconds. In a situation such as this, the new closure state of the lock, which is determined by the evaluation unit by, for example, comparison of the new contact sequence with a contact sequence that is stored in a memory in the evaluation unit, is stored and is output acoustically and/or visually.

It is also possible to provide for the activation switch to be used at the same time for programming the evaluation unit. It is thus possible, for example, to switch between a lock which is closed in the clockwise direction and a lock which is closed in the counterclockwise direction via the activation switch by means of appropriate reprogramming of the logic for the evaluation unit, or to make an appropriate selection of a different characteristic contact sequence which is stored in the memory of the evaluation unit when, for example, this is held depressed for a lengthy time period of 15 to 20 seconds. A change such as this to the closing direction of a lock, which allows individual matching of the apparatus according to the invention to different locks, can be indicated subsequently to this, for example likewise visually or acoustically.

According to a further preferred embodiment of the invention, the evaluation unit is preferably provided with a timer which his connected to the evaluation unit or is contained in it and which, once a closing process has been carried out successfully, produces a time signal which is supplied to the evaluation unit. The evaluation unit can use the signal from the timer to determine the closing time and to supply this a display for indication on which, if desired, to the user of the apparatus according to the invention can read the time of the last closing process at any time. In the same way, the timer can also be used to determine the current clock time, which can likewise be indicated on the display. In the simplest case, the timer may be in the form of a digital clock.

The display, which is preferably a known LCD display, may likewise be used for indication of the current closure state of the lock, wherein case it is possible to switch between the various display modes, for example likewise by means of preferably repeatedly pressing the activation switch within a specific time period. In the same way, the activation switch can be used to switch on a light for the display.

Additionally or as an alternative to an optical indication on a display, it is possible to provide for the closure state or else the fact that a closure process has been carried out to be output by means of an acoustic signal transmitter which produces an acoustic signal when there is an electrically conductive connection between two adjacent contacts of the rotation direction sensor. It is thus possible, for example in the case of a corresponding arrangement having a total of eight contacts in the form of four contact pairs, for an opening process to be indicated by four beep signals and for a locking process to be indicated by, for example, three beep signals, which can be initiated during the respective closing process when the corresponding contact pairs are bridged by the first electrically conductive liquid. The acoustic signals during this closing process are used primarily to confirm acoustically to the user that the apparatus is serviceable and that a closing process has been identified correctly by the indication apparatus according to the invention, thus allowing operation to be monitored when it is dark and also making it possible for the user to notice that the apparatus has been operated inadvertently in the pants pocket and, for example, to make it possible to reverse this via the activation switch or a further operating switch.

Finally, according to a further embodiment of the invention, it is possible after a closing process to press the activation switch to indicate the current closure state by means of a blinking light-emitting diode, for example a red diode for an open lock and a green diode for a closed lock, and it is also possible to display the clock time at which the closing process took place, at the same time, in a particularly advantageous manner.

According to one embodiment of the invention which is particularly advantageous from the esthetic point of view, the hollow body is arranged such that it is visible from the outside in the housing which, for this purpose, can be manufactured from transparent plastic. This opens up the possibility for the viewer firstly to have a further checking capability for the operation of the rotation direction sensor and secondly for the interest of external viewers to be directed at the apparatus according to the invention which is advantageous in particular when the apparatus is used as an advertising medium, for which purpose, for example, the advertisement may be applied to the rear face of the housing.

In the preferred embodiment of the invention, the power supply for the indication apparatus is provided by means of a battery and/or a rechargeable battery, but, as an alternative or in addition, it is also possible to use solar modules for this purpose.

According to the preferred embodiment of the invention, the evaluation unit is in the form of a digital and/or analog microchip circuit, whose function and states can be programmed and are stored in a preferably erasable and rewritable memory.

Other features which are considered as characteristic for the invention are set forth in the appended claims.

Although the invention is illustrated and described herein as embodied in an apparatus for indication of the closure state of a lock, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIGS. 3A to 3H are similar sections showing the position of the hollow body and of the liquids contained in it during one complete revolution of the key head during a closing process;

DESCRIPTION OF THE PREFERRED EMBODIMENTS

Figure 1:
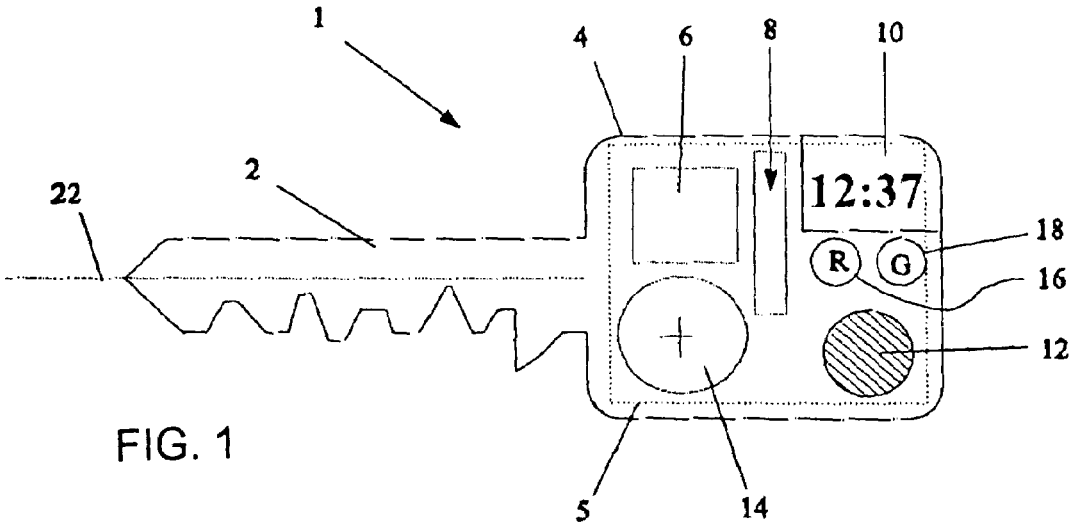
FIG. 1 is a side view of the indication apparatus according to the invention, with the individual components illustrated schematically.

Referring now to the figures of the drawing in detail and first, particularly, to FIG. 1 thereof, there is shown an apparatus 1 according to the invention. For the purpose of indicating the closure state of a non-illustrated key-operated lock, the apparatus has a housing 4 which is arranged on a key body 2 and wherein an evaluation unit 6 in the form of an electronic circuit is arranged on a board 5. As is likewise shown in FIG. 6, the evaluation unit 6 is connected to a rotation direction sensor 8 according to the invention, which is arranged in the same way within the housing 4, to a display 10 which can be read from the outside for indication of the closure state and/or of the closing time and/or of the clock time, to an activation switch 12 which can be operated from the outside for activation of the evaluation unit 6, and/or for switching between different indication forms on the display 10, to a timer 13, and to a power source 14 in the form of a battery.

According to one particularly simple embodiment of the invention, two light-emitting diodes 16 and 18 which can be read from the outside can also be disposed within the housing 4, which indicate the respective closure state after pressing the activation switch 12 as, for example, a red light signal R for an open lock and as a green light G for a locked lock.

Figure 2:
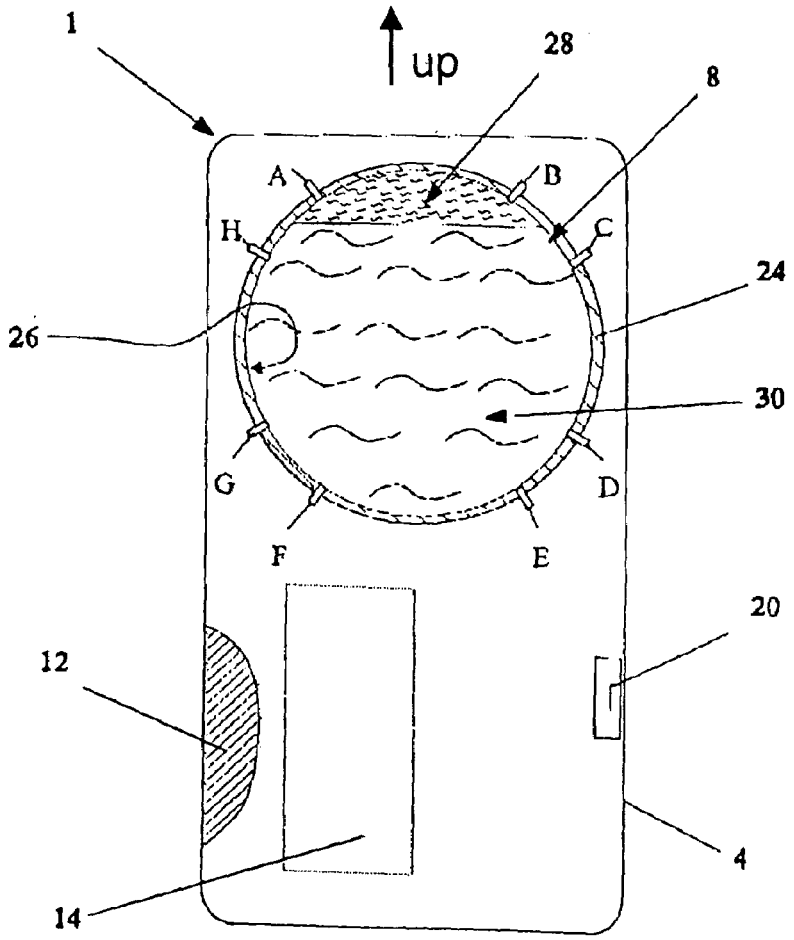
FIG. 2 is a section through the indication apparatus of FIG. 1, at the level of the rotation direction sensor, with a cylindrical hollow body, wherein the operating switch and the battery as well as the acoustic signal transmitter are also shown.
Figure 4:
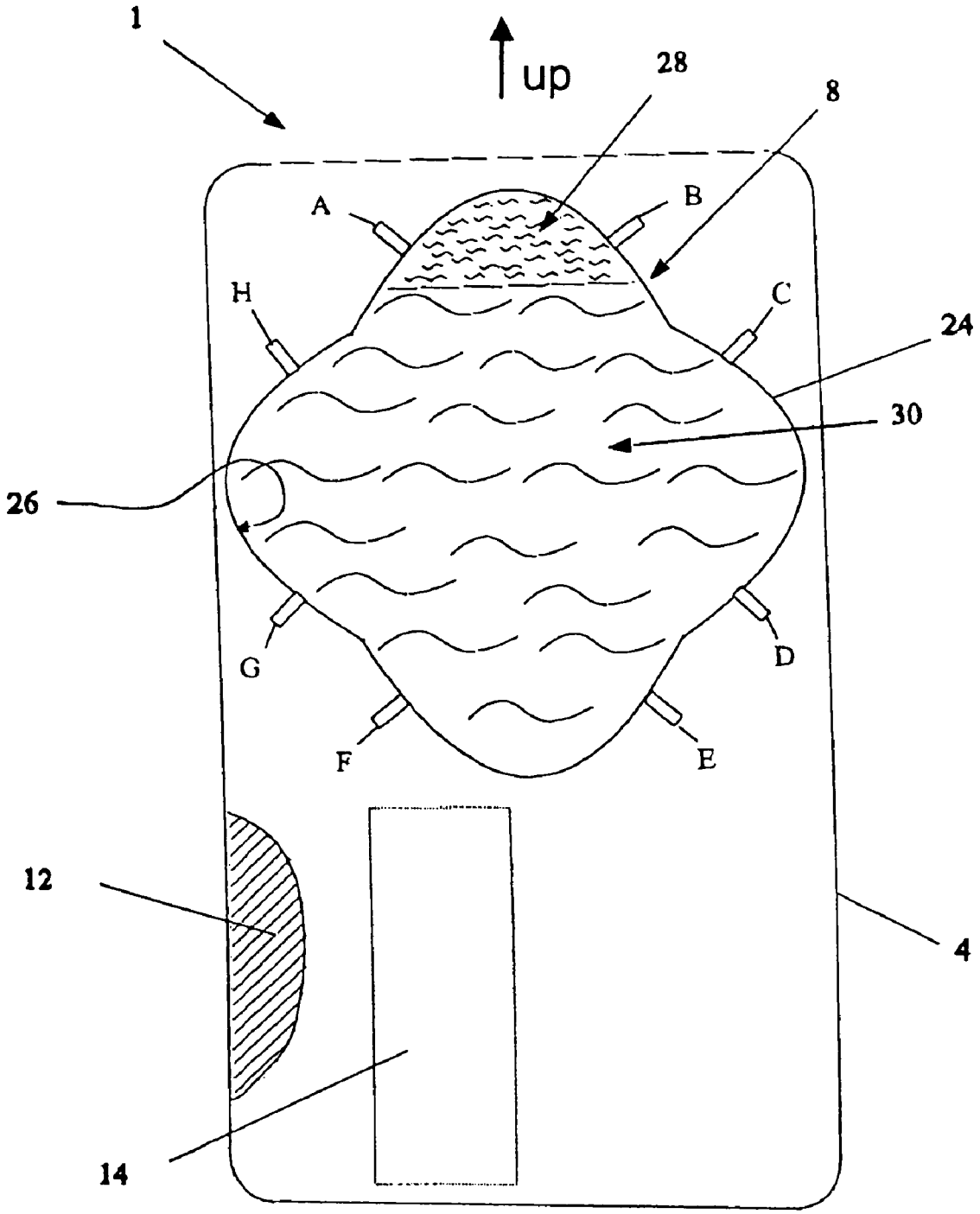
FIG. 4 is a section through a further embodiment of an indication apparatus according to the invention with a rotation direction sensor, which has a cross section that is composed of a number of circular arc sections.
Figure 5:
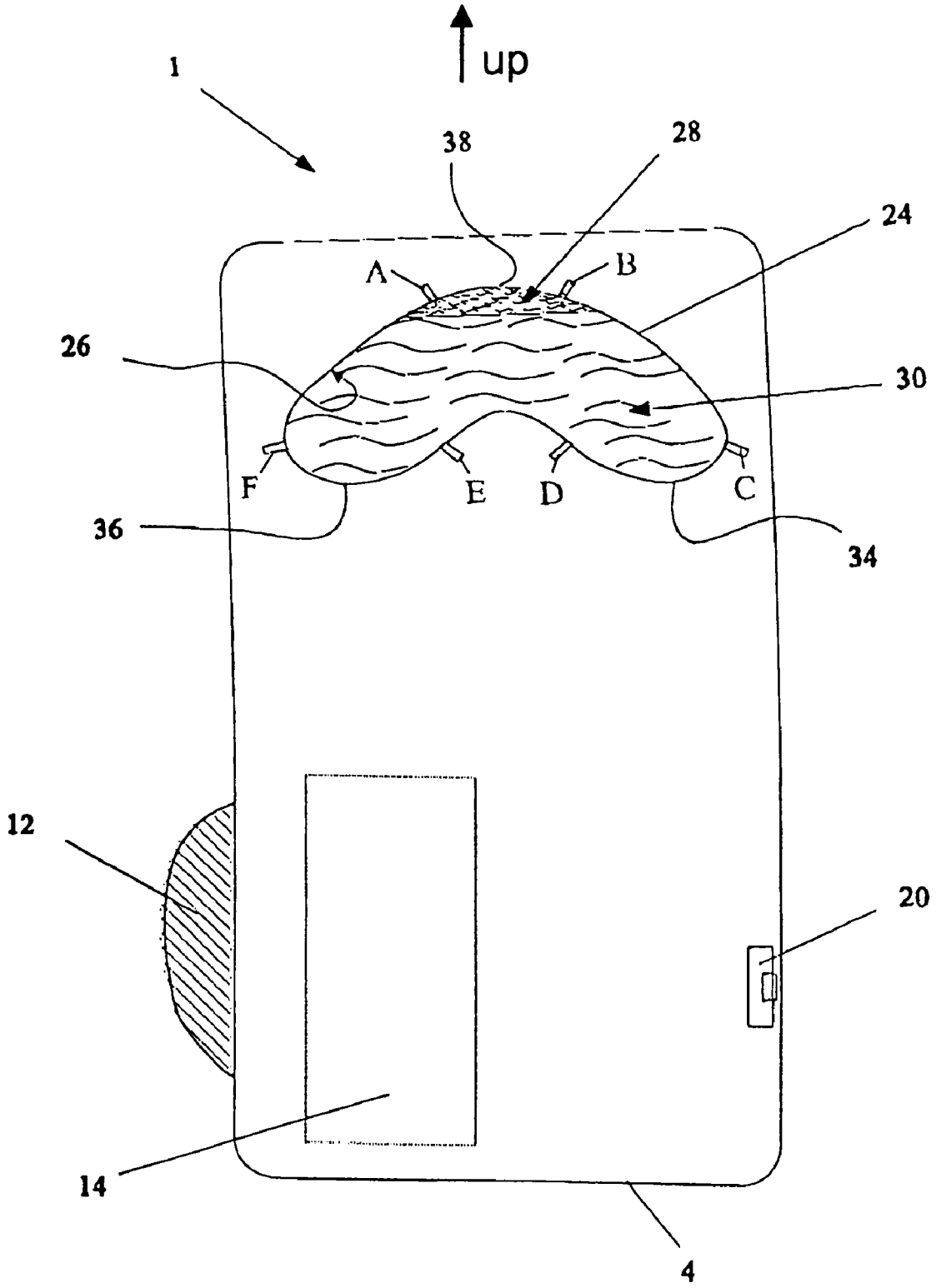
FIG. 5 is a similar section through a further embodiment of an indication apparatus according to the invention having a rotation direction sensor which has a substantially kidney-shaped cross section.
Figure 6:
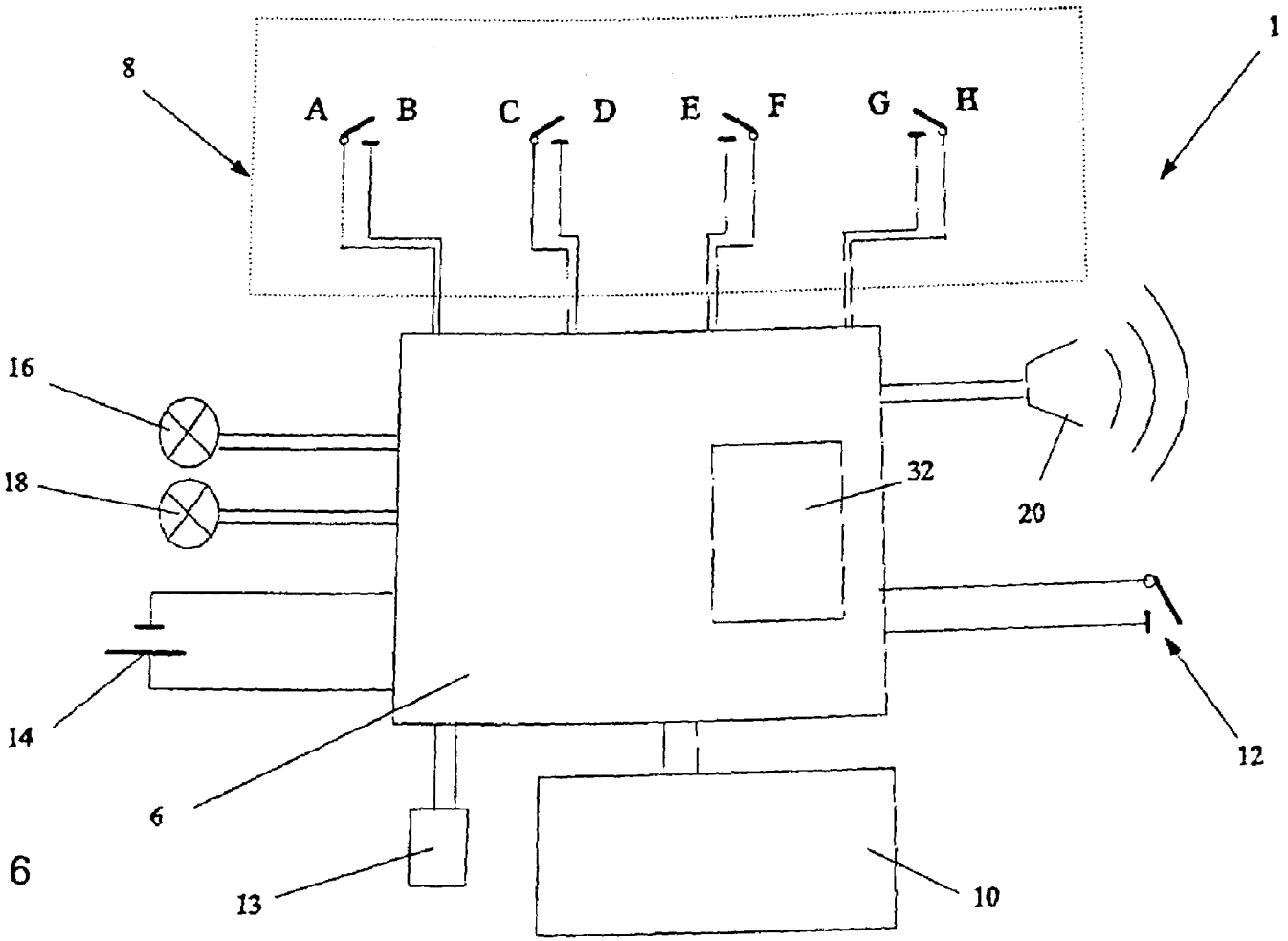
FIG. 6 is a block diagram of the indication apparatus according to the invention.

With reference to the illustration in FIG. 2, an acoustic signal transmitter 20 may optionally be arranged within the housing 4 and is likewise connected to the evaluation unit 6, and which emits a specific number of beep signals during a closing process, in order to signal to the user that the apparatus 1 according to the invention is operating correctly. As is illustrated in FIGS. 2, 4 and 5, the rotation direction sensor 8 comprises a closed hollow body 24 which is disposed substantially perpendicularly to the rotation axis 22 of the key in the lock as indicated in FIG. 1, and which is provided in the region of its inner wall 26 with electrical contacts A, B, C, D, E, F, G, H. The contacts are arranged spaced from one another at defined distances and—as is illustrated in FIG. 6—are connected to the evaluation unit 6.

A first electrically conductive liquid 28 is located within the hollow body 24, as well as a second electrically non-conductive liquid 30, which cannot be mixed with the first liquid 28. The second liquid 30 has a higher density than the first liquid 28 and it is thus located in the (geodetically) lower part of the hollow body 24. However, it is likewise feasible in the same manner for the electrically conductive first liquid to have a higher density than the second electrically non-conductive liquid. In that case, of course, the logic for the evaluation unit 6 is then adapted appropriately.

In another variation, the first liquid 28 may also be replaced by a material in gaseous phase and, in yet another alternative, the space otherwise occupied by the first liquid (or fluid) 28 may be evacuated to a relatively high vacuum.

The second fluid (typically a liquid) 30 must be accordingly chosen to have a relatively high cohesion factor, so as not to flow into the "empty space" formed by the vacuum bubble, i.e., into the space of the first fluid 28. It should be readily understood that, in this variation as well, the logic of the evaluation unit 6 must be reversed relative to the logic associated with the system illustrated in FIG. 2.

As can be seen from the illustration in FIGS. 3A to 3H, the position of the hollow body 24 and hence of the contacts A, B, C, D, E, F, G, H with respect to the two liquids 28, 30 is changed when the key is rotated in the clockwise direction as corresponds, for example, to a locking process, with the two liquids 28, 30 essentially maintaining their relative positions owing to the force of gravity. In consequence, when the key is inserted into the lock, the contacts A and B, and after rotation through 90°, 180° and 270°, the contacts G–H; E–F and C–D, are bridged by the electrically conductive first liquid 28 until, at the end of the closing process, the hollow body 26 is once again in the initial position, wherein the contacts A–B are once again bridged. The evaluation unit identifies this contact sequence of successive contact closures and uses them to determine the closure state of the lock as "locked", which is then indicated on the display 10, or indicated by illumination of the green light-emitting diode 18.

In a corresponding manner during an opening process with the key 2 being rotated in the opposite direction in the lock, the contacts pass through the sequence A–B, C–D, E–F, G–H, A∝B, which the evaluation unit 6 identifies as an opening process, and indicates appropriately.

The determination of the closure state as a function of the rotation direction may in this case be carried out by comparing the detected contact sequence with contact sequences (which are stored in a memory 13 (FIG. 6) in the evaluation unit 6) for an opening and a locking process, wherein case the contact sequences which are associated with an opening process can be interchanged with the contact sequences that are associated with a locking process by means of a further switch which is not illustrated, or by operating the activation switch 12 for a lengthy period, in order to make it possible to change between a lock which closes in the left-hand direction and a lock which closes in the right-hand direction.

As is indicated by means of the schematically illustrated soundwaves in FIGS. 3A, 3C, 3E and 3G, a conductive connection between the contacts A–B, G∝H, E–F and C–D results in activation of the acoustic signal transmitter 20, so that the user is additionally provided with acoustic monitoring of the closing process.

In the embodiment of the hollow body 24 illustrated in FIG. 4, the internal circumferential surface 26 of the hollow body 24 is composed of segments in the form of arcs in order to enlarge the angular range wherein the respective contacts A–B, G–H, E–F, C∝D are conductively bridged by the first liquid 28.

The cross-sectional shape of the hollow body in the form of a cardioid or kidney as shown in FIG. 5 allows the indication apparatus 1 according to the invention to be refined such that it is particularly suitable for detection of a closing process wherein the key is rotated forwards and backwards only through a predetermined angular range of, for example, 30° in the clockwise direction or in the counterclockwise direction. In this case, it is possible by variation of the angle between the two bulges 34 and 36 of the bottom to match the reversal point 38, which is located between the contacts A and B, to the angular magnitude of an existing lock. This embodiment of the invention is particularly suitable for use in conjunction with an activation switch which is pushed by hand before insertion of the key into the respective lock, for example a motor vehicle lock.

I claim:

1. An apparatus for indicating a closure state of a key-operated lock, comprising:

a housing mounted to a key keyed to the lock;

a rotation direction sensor disposed in said housing and having:

a hollow body substantially completely filled with a first electrically conductive fluid and with a second electrically non-conductive fluid repelling the first fluid; and electrically conductive contacts for production of electrical contact sequences in dependence on a position of the first fluid and the second fluid in said hollow body representing a closing direction;

an electronic evaluation unit connected to receive the electrical contact sequences to determine the closure state of the lock.

2. The apparatus according to claim 1, wherein the first fluid is a first liquid and the second fluid is a second liquid, and the first liquid has a lower density than the second liquid.

3. The apparatus according to claim 1, wherein said hollow body has a shape of a prism with two base surfaces extending substantially parallel to one another and substantially perpendicular to a rotation axis of the key in the lock.

4. The apparatus according to claim 1, wherein said hollow body has a substantially cylindrical cross-sectional shape.

5. The apparatus according to claim 1, wherein said hollow body has a cross-sectional shape substantially composed of circular arc sections.

6. The apparatus according to claim 1, wherein said hollow body has a substantially kidney-shaped cross section.

7. The apparatus according to claim 1, which comprises an activation switch connected to said evaluation unit and disposed on said housing.

8. The apparatus according to claim 7, wherein an operation of said activation switch followed within a predetermined time period by a given contact sequence representing a locking process causes an activation of said evaluation unit and an output indication of a new closure state.

9. The apparatus according to claim 7, wherein said evaluation unit is configured to be switched, via said activation switch, between a clockwise-locking lock and a counterclockwise-locking lock.

10. The apparatus according to claim 1, which further comprises a timer connected to said evaluation unit or contained therein, for determining a last closing time.

11. The apparatus according to claim 1, which comprises a display disposed on said housing and connected to said evaluation unit, for displaying at least one of a closing time and the closure state of the lock.

12. The apparatus according to claim 1, which comprises an acoustic signal transmitter configured to produce an acoustic signal when an electrically conductive connection is formed between two adjacent said contacts of said rotation direction sensor.

13. The apparatus according to claim 1, which comprises a first visual indicator, for signaling a closed state of the lock, and a second visual indicator, for signaling an opened closure state of the lock.

14. The apparatus according to claim 1, which comprises at least one visual indicator for signaling a closed state of the lock and for signaling an opened closure state of the lock.

15. The apparatus according to claim 1, which comprises a power source for powering the apparatus.

16. The apparatus according to claim 15, wherein said power source is one of a battery, a rechargeable battery, and a solar cell.

17. The apparatus according to claim 1, wherein said evaluation unit comprises microchip circuit, and function and states of the circuit are programmable.

18. The apparatus according to claim 17, wherein said microchip circuit is a digital and/or analog circuit.

* * * * *